United States Patent [19]

Brännström et al.

[11] 4,421,036

[45] Dec. 20, 1983

[54] PLANT FOR THE COMBUSTION OF IMPURE SOLID FUEL

[75] Inventors: Roine Brännström, Finspong; Lars-Erik Karlsson, Aby, both of Sweden

[73] Assignee: Stal-Laval Turbine AB, Västeras, Sweden

[21] Appl. No.: 347,204

[22] Filed: Feb. 9, 1982

[30] Foreign Application Priority Data

Feb. 19, 1981 [SE] Sweden ..... 8101110

[51] Int. Cl.[3] ..... F23H 5/18

[52] U.S. Cl. ..... 110/186; 110/245; 110/263

[58] Field of Search ..... 110/342, 345, 245, 263, 110/185, 186; 122/4 D; 423/244

[56] References Cited

U.S. PATENT DOCUMENTS

| | | | |
|---|---|---|---|
| 3,693,557 | 9/1972 | Makuch | 110/342 |
| 4,177,741 | 12/1979 | Stewart et al. | 110/342 X |
| 4,259,911 | 4/1981 | Jones | 110/245 |
| 4,262,610 | 4/1981 | Hein et al. | 110/342 |
| 4,279,207 | 7/1981 | Wormser | 110/345 |
| 4,329,324 | 5/1982 | Jones | 110/345 |

FOREIGN PATENT DOCUMENTS 1528623 10/1978 United Kingdom .

*Primary Examiner*—Edward G. Favors
*Attorney, Agent, or Firm*—Pollock, Vande Sande & Priddy

[57] ABSTRACT

In a fluidized bed plant for the combustion of impure solid fuel in the presence of an absorbent material which absorbs and neutralizes the impurities, in particular sulfur, the supply of absorbent material to the fluidized bed is controlled in dependence on the impurity content in the exhaust gases leaving the fluidized bed. To achieve a rapid control, at least part of the absorbent material is supplied to the fluidized bed in a finely ground state. The bed material may consist of coarse-grained absorbent material or a chemically inactive material, or a mixture of these. Coarse-grained absorbent material which is discharged from the fluidized bed can have its particle size reduced and be passed back to the fluidized bed.

13 Claims, 4 Drawing Figures

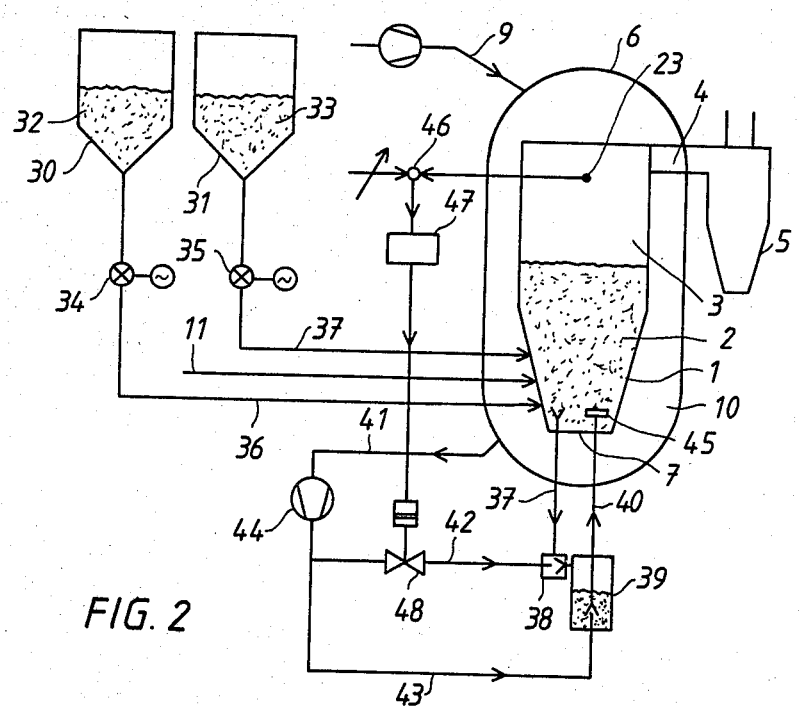
FIG. 2
FIG. 3
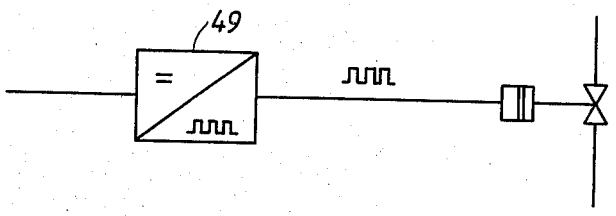

PLANT FOR THE COMBUSTION OF IMPURE SOLID FUEL

TECHNICAL FIELD

This invention relates to a plant with a combustion chamber for the combustion of impure solid fuel, in particular coal, in a fluidized bed. The combustion chamber may operate at atmospheric pressure or at superatmospheric pressure, for example at a pressure of from about 10 to 20 bar. Such a combustion chamber may form part of a combined power plant comprising a gas turbine, which is supplied with gas from the combustion chamber, and a steam turbine supplied with steam from steam generators arranged in the combustion chamber and downstream of the gas turbine for recovering heat from the gases leaving the gas turbine.

BACKGROUND ART

During combustion of solid fuel, in particular coal, certain impurities in the fuel, especially sulfur, have to be contended with. These impurities involve certain drawbacks, especially for the environment. One advantage of allowing the combustion to take place in a fluidized bed is that the bed material may consist of, or be supplied with, an absorbent material which absorbs and binds the impurities so that these are deposited in the form of harmless powder or slime.

Doolmite or limestone may be used as a bed material and sulfur absorbent material. Such material is supplied to the combustion chamber in particulate form, for example with a particle size in the range of from about 0.05 to about 6 mm. When sulfur-containing fuel is burnt in the fluidized bed, the sulfur reacts with the oxygen of the combustion air and forms sulfur dioxide which reacts with the active component or components in the sulfur absorbent material, for example calcium. This may occur, for example, by the absorbent material first being calcined, that is, carbon dioxide escapes from the absorbent material. After that, the surface of each particle of the sulfur absorbent material becomes sulfatized, with the formation of calcium sulfate on its surface. The sulfatization of the particles then becomes deeper and deeper from the surface.

It has been found that very small particles of the absorbent material are sulfatized very rapidly whereas large particles, even after a long residence time in the fluidized bed, are still sulfatized only to a minor extent.

The supply of absorbent material takes place continuously and is controlled with respect to the sulfur content in the fuel. Fine particles of the absorbent material are sulfatized rapidly and some of these leave the combustion chamber with the exhaust gases and are collected in a cleaner. Coarse particles are sulfatized slowly and remain in the bed. For the bed height to be maintained constant, bed material must be removed from the fluidized bed either constantly or intermittently. This withdrawn bed material is then often sulfatized only partially in spite of a long residence time in the bed.

The present invention aims to provide a plant for the combustion of impure solid fuel which makes it possible to improve the utilization of, and thus reduce the consumption of sulfur absorbent material.

DISCLOSURE OF THE INVENTION

According to the invention, a plant for the combustion of impure solid fuel comprises a combustion chamber, means for supplying said impure solid fuel to said combustion chamber, means for supplying fine-grained and coarse-grained absorbent material to said combustion chamber for absorbing impurities formed in said combustion chamber by combustion of said solid fuel therein, means for creating a fluidized bed of said absorbent material in said combustion chamber, means for withdrawing absorbent material from said fluidized bed, and means for returning at least some of the withdrawn absorbent material to said fluidized bed with reduced grain size.

In use of a plant in accordance with the invention, the reduction in size of the withdrawn absorbent material exposes the inner unused absorbent material so that after it is returned to the fluidized bed it is again effective as an absorbent. The feedback of the absorbent material of reduced grain size may suitably be controlled in dependence on the sulfur dioxide content in the exhaust gas leaving the fluidized bed. Because the returned absorbent material is finely-divided and therefore efficient from the point of view of absorption, a fast regulating effect can be achieved.

In a plant in accordance with the invention having a combustion chamber which operates at superatomspheric pressure, the absorbent material can be removed from the fluidized bed, and then be cooled, sieved and crushed outside the pressure vessel which surrounds the combustion chamber. Thus, the treatment of the removed absorbent material can be carried out at atmospheric pressure.

However, by employing pneumatic feeding-out devices and return feeding devices for the absorbent material it is possible to operate at the pressure of the plant. The reduction in grain size of the absorbent material may be effected by projecting the absorbent material against a plate when it is fed back into the combustion chamber, so that the grains are crushed. The advantages of this are that pressure reduction, temperature reduction and pressure increase can be eliminated during the return of the absorbent material to the fluidized bed and that it is possible to operate substantially without movable parts in severe environments involving high temperature, high pressure, dust, ect.

BRIEF DESCRIPTION OF THE DRAWINGS

The invention will now be described, by way of example, with reference to the accompanying drawings, in which FIGS. 1, 2 and 4 are schematic diagrams of three different embodiments of plants in accordance with the invention, and FIG. 3 is a diagram of a regulating device for use in the plant of FIG. 2.

DESCRIPTION OF PREFERRED EMBODIMENTS

Figure 1:
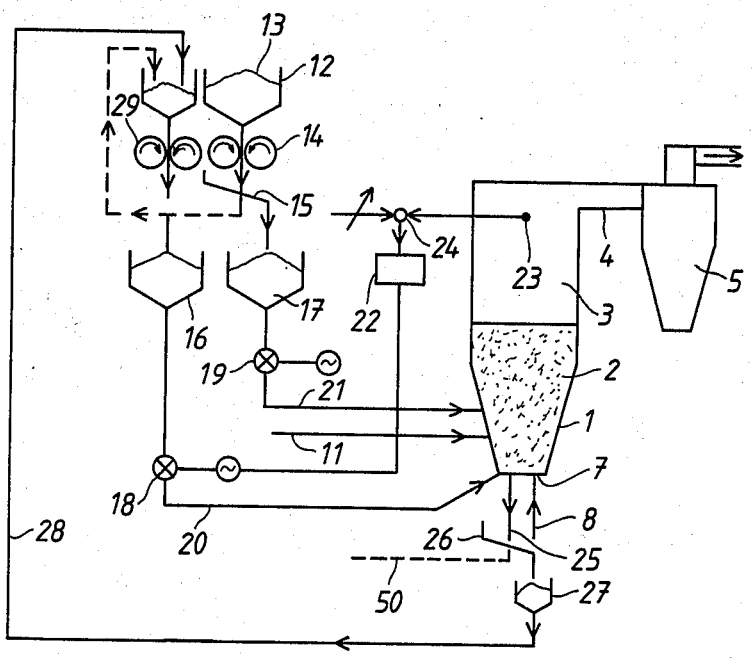

In the plant shown in FIG. 1, the numeral 1 designates a combustion chamber in which solid fuel is burnt in a fluidized bed 2 above which there is a free space 3. The combustion chamber 1 communicates via an outlet 4 with a cleaner 5, for example of the cyclone type, in which dust is separated from the exhaust gases from the bed 2. This dust consists of ashes and fine fractions of absorbent material. A conduit 8 supplies air under pressure to nozzles (not shown) in the bottom 7 of the combustion chamber 1, this air serving to fluidize the material in the bed 2 and also serving as combustion air for the solid fuel which is injected into the bed 2 via a conduit 11. Initiation of the combustion process in the chamber 1 is effected in any suitable conventional way, for example employing an oil burner (not shown). Once the combustion process has been initiated, it is self-supporting so long as solid fuel and combustion air are supplied to the chamber 1.

The numeral 12 designates a container for fresh sulfur absorbent material 13, for example limestone or dolomite. Absorbent material 13 leaving the lower end of the container 12 is crushed in a mill 14 to a grain size of less than 6 mm. The crushed material leaving the mill 14 is sieved in a sieve 15 and divided into fine and coarse fractions. The fine fraction from the sieve 15 is fed to a mill 29 for further milling. The fine and coarse fractions are collected and stored in containers 16 and 17, respectively. The bed 2 is supplied with fine and coarse absorbent material from the containers 16 and 17 via batching devices 18 and 19 and conduits 20 and 21, respectively, for example employing compressed-air injection. The batching devices 18 and 19 may each consist of a cylindrical chamber with a rotary vaned wheel, the speed of rotation of which can be regulated.

The batching device 19 can be controlled so as to provide a flow of the coarse fraction of the absorbent material to the bed 2 which is either constant or bears a constant relationship to the flow of solid fuel to the bed 2. On the other hand, the batching device 18 for the fine fraction of the absorbent material is controlled by a regulator 22 in dependence on the impurity content of the exhaust gases from the bed 2. For this purpose there is provided downstream of the bed 2, for example above the bed, downstream of the cleaner 5 or in the chimney (not shown) to which the exhaust gases pass, a transducer or detector 23 which measures the concentration of sulfur dioxide in the exhaust gases. Signals from the detector 23 arre led to an input circuit 24 for the regulator 22, to which also a desired value for the concentration of sulfur dioxide in the exhaust gases is fed. Even if this desired value is chosen as low as is practically possible, it cannot in practice be set at zero since this would probably result in a constant surplus of absorbent material, which is both impractical and uneconomical. The sulfur dioxide detector 23 may be of the kind known under the Trade Mark "Thermo-Electron".

The chamber 1 is provided with an outlet 25 through which material may be removed from the bed 2, so that the height of the bed may be adjusted during operation of the combustion chamber. The outlet 25 leads to a sieve 26 for dividing the removed material into fine and coarse fractions. The fine fraction may be considered to consist of consumed absorbent material, which can be discharged through a conduit 50 for disposal in a suitable manner. The grains of the coarse fraction contain unconsumed absorbent material in their inner part. This unconsumed part may amount to 50% or more. The coarse fraction is collected in a container 27 and is transported through a conduit 28 to the mill 29, where it is crushed into fine particles, preferably smaller than 0.1 mm. As previously mentioned, the crushed material from the mill 29 is collected in the container 16.

In the plant shown in FIG. 2, items which are the same as, or similar to, items in the plant of FIG. 1 have been designated with the same reference numerals as in FIG. 1. In FIG. 2, the combustion chamber 1 operates at superatmospheric pressure and is therefore enclosed in a container 6 which is capable of containing air under pressure which is supplied, via a conduit 9, to the space 10 between the container 6 and the chamber 1. As in the case of the plant of FIG. 1, the bottom of the chamber 1 comprises nozzles (not shown) through which air from the space 10 enters the bed 2 to serve as combustion air and to fluidize the material of the bed 2. The plant includes closed containers 30 and 31, respectively, for fine-grained absorbent material 32 and coarse-grained absorbent material 33. Pressure can be applied to these containers 30 and 31 so that the pressure in them is as high as in the container 6. The batching of absorbent material from the containers 30 and 31 takes place through batching devices 34 and 35, respectively, and the absorbent material is supplied to the bed 2 through conduits 36 and 37 by pneumatic conveyance. Material is withdrawn from the bed 2 through a feed-out conduit 37 and a pneumatic feed-out device 38 of the ejector type and is transported to a return feed device 39 (also of the ejector type) through a conduit 40. The ejector devices 38 and 39 are supplied with gas under pressure from the container 6 via conduits 41, 42 and 43 and a pressure-increasing compressor 44. Absorbent material which is returned to the combustion chamber 1 is projected against a plate 45 so that the grains of absorbent material are crushed, and unconsumed absorbent material in the returned material is exposed and becomes effective from the point of view of absorption. Control of the withdrawal and return of absorbent material by the ejector devices 38 and 39 is carried out in dependence on the sulfur dioxide content in the exhaust gases leaving the bed 2, which is measured by the detector 23. Signals from the detector 23 are passed to the input circuit of a regulator 47 which controls a valve 48 in the conduit 42. The regulator 47 can also be employed to control the batching device 34. The regulator 47 may contain a pulse generator 49, as shown in FIG. 3. The pulse generator 49 produces operating pulses for opening and closing the valve 48. The opening of the valve is determined by the pulse length. The pulse repetition frequency may be constant, whereas the pulse length may vary.

Figure 4:
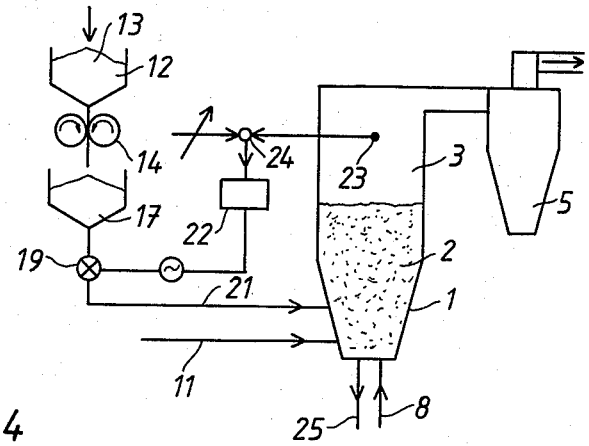

In the plants shown in FIGS. 1 and 2, the coarse fraction of the absorbent material may serve both as an absorbent and as the fluidized bed material. However, the bed may also be provided with a particulate bed material, consisting for example, of a chemically inactive mineral material, for example quartz sand, or of an artificial compound, for example, of the kind known under the trademark "MOLOCHITE". The bed is then supplied with only fine-crushed absorbent material. This results in a certain simplification of the design. In an atmospheric fluidized bed the design according to FIG. 1 is thus simplified to a design according to FIG. 4. A super-atmospheric fluidized bed will correspondingly be simplified in its design.

What is claimed is:

1. A plant for the combustion if impure solid fuel, comprising:

a combustion chamber;

means for supplying impure solid fuel to said combustion chamber;

means for supplying fine-grained and coarse-grained absorbent material to said combustion chamber, said absorbent material being effective to absorb sulfur formed in said combustion chamber by combustion of said solid fuel therein;

means for creating a fluidized bed of said absorbent material in said combustion chamber;

means for withdrawing absorbent material directly from ssaid fluidized bed;

means for crushing said absorbent material withdrawn directly from said fluidized bed into a fine-grained absorbent material;

transducer means for producing a first signal proportional to the sulfur dioxide content in the exhaust gases leaving said fluidized bed;

signal processing means, connected to said transducer means, for comparing said first signal with a second signal proportional to a desired value of the sulfur dioxide content; and regulator means, connected to said signal processing means, for regulating the flow into said fluidized bed of fine-grained absorbent material produced by said means for crushing, in response to the difference between said first and second signals.

2. A plant according to claim 1, further comprising a pneumatic conveying device for conveying absorbent material from said means for withdrawing absorbent material from the fluidized bed to said means for crushing.

3. A plant according to claim 2, wherein said regulator means controls said means for withdrawing absorbent material.

4. A plant according to claim 3, wherein said regulator means closes and opens a valve in said pneumatic conveying device in order to regulate the flow of absorbent material from said fluidized bed.

5. A plant according to claim 4, wherein said regulator means controls the withdrawal of absorbent material from, and its return to, said fluidized bed by varying the time during which said valve is held open.

6. A plant according to claim 1, comprising separate conveying devices for conveying fine-grained and coarse-grained absorbent material to said fluidized bed.

7. A plant according to claim 1, wherein the output of fine grained absorbent material from said means for crushing is returned to said means for supplying fine grained and coarse grained absorbent material.

8. A plant according to claim 1, wherein said means for crushing comprises a plate within said combustion chamber and means, connected to said means for withdrawing, for projecting withdrawn material against said plate so that the grains of absorbent material are crushed.

9. A plant according to claim 2, wherein said means for crushing comprises a plate within said combustion chamber and means, connected to said means for withdrawing, for projecting withdrawn material against said plate so that the grains of absorbent material are crushed.

10. A plant according to claim 1, wherein said means for withdrawing comprises a first pneumatic ejector means connected to said fluidized bed for withdrawing material therefrom; and said regulator means comprises a source of pressurized air connected to said first pneumatic ejector means and a valve between said source and said first pneumatic ejector means for controlling air flow to said first pneumatic ejector means.

11. A plant according to claim 10, wherein said means for crushing comprises a plate within said combustion chamber and means, connected to said first pneumatic ejector means, for projecting withdrawn material against said plate so that the grains of absorbent material are crushed.

12. A plant according to claim 11, wherein said means for projecting comprises a second pneumatic ejector means, connected to the output of said first pneumatic ejector means, for projecting withdrawn material against said plate.

13. A plant according to claim 12, wherein said regulator means controls the withdrawal of absorbent material from, and its return to, said fluidized bed by varying the time during which said valve is held open.

* * * * *